US011000081B1

(12) United States Patent
Dobbins

(10) Patent No.: US 11,000,081 B1
(45) Date of Patent: May 11, 2021

(54) PULLEY FACE MASK WITH NECK CATCH

(71) Applicant: Lisa S. Dobbins, Charleston, WV (US)

(72) Inventor: Lisa S. Dobbins, Charleston, WV (US)

( * ) Notice: Subject to any disclaimer, the term of this patent is extended or adjusted under 35 U.S.C. 154(b) by 0 days.

(21) Appl. No.: 17/067,254

(22) Filed: Oct. 9, 2020

(51) Int. Cl.
*A41D 13/11* (2006.01)

(52) U.S. Cl.
CPC ..... *A41D 13/1161* (2013.01); *A41D 13/1107* (2013.01)

(58) Field of Classification Search
CPC ..... A41D 13/11; A41D 13/1161; A41D 13/1107; A41D 13/1138; A41D 13/1184
USPC ..... 2/9; 128/202.15, 205.27, 206.12, 206.19
See application file for complete search history.

(56) References Cited

U.S. PATENT DOCUMENTS 2,281,744 A * 5/1942 Brunner ..... A41D 13/1161 128/206.13
5,237,986 A * 8/1993 Seppala ..... A41D 13/1146 128/201.23
5,819,731 A * 10/1998 Dyrud ..... A41D 13/1146 128/206.27
2015/0335080 A1* 11/2015 Giles ..... A41D 13/1115 128/863

* cited by examiner

*Primary Examiner* — Katherine M Moran
(74) *Attorney, Agent, or Firm* — Andrew D. Wright; Roberts Calderon Safran & Cole, P.C.

(57) ABSTRACT

A face mask system includes: a mask configured to be worn on a face of a user; and a cord extending continuously between a first end of the cord attached to the mask at a first attachment location and a second end of the cord attached to the mask at a second attachment location, wherein the cord forms a first ear loop configured to be worn around a first ear of the user, a second ear loop configured to be worn around a second ear of the user, and a neck loop configured to be worn on a neck of the user. The cord provides a pulley system that permits individual adjustment of a respective tightness of each of the first ear loop and the second ear loop.

19 Claims, 9 Drawing Sheets

PULLEY FACE MASK WITH NECK CATCH

FIELD OF THE INVENTION

Aspects of the invention generally relate to face masks and, more particularly, to systems for securing a face mask to a person wearing the face mask.

BACKGROUND

Face masks are a type of personal protective equipment that are designed to reduce or eliminate airborne pollutants and/or pathogens from entering an airway of a user wearing the face mask. Face masks have become ubiquitous in the year 2020, with many jurisdictions and private enterprises requiring that individuals wear some type of face covering.

SUMMARY

According to aspects of the invention, a pulley face mask with neck catch (e.g., cord) is a face mask with a pulley cord that fully adjusts behind and around the ears and behind and around the neck. The pulley system design allows adaptable comfort for each individual having the capabilities of form and function while protecting the user from airborne pollutants. The catch (e.g., cord) can be made of an elastic type material or non-stretch materials and can be attached to disposable masks or reusable masks made of medical or non-medical grade fabrics of any shape or size or any other variable of a face mask. In some embodiments, the face mask itself is not part of the claimed invention but the system to adjust around the ears and neck is what is being set forth; assembly of the cord may vary, as well. In other embodiments, the claimed invention includes the face mask and the cord.

In a first aspect of the invention, there is a face mask system that includes: a mask configured to be worn on a face of a user; and a cord extending continuously between a first end of the cord attached to the mask at a first attachment location and a second end of the cord attached to the mask at a second attachment location, wherein the cord forms a first ear loop configured to be worn around a first ear of the user, a second ear loop configured to be worn around a second ear of the user, and a neck loop configured to be worn on a neck of the user. In embodiments, the cord provides a pulley system that permits individual adjustment of a respective tightness of each of the first ear loop and the second ear loop. In embodiments, a tightness of the first ear loop is adjustable independently of a tightness of the second ear loop, and the tightness of the second ear loop is adjustable independently of the tightness of the first ear loop. In embodiments, the first ear loop is tightened by pulling on a first portion of the cord, the first ear loop is loosened by pulling on a second portion of the cord, the second ear loop is tightened by pulling on a third portion of the cord, and the second ear loop is loosened by pulling on a fourth portion of the cord. In embodiments, the first ear loop comprises a first portion of the cord that extends between a first hole of the mask and a second hole of the mask, and the second ear loop comprises a second portion of the cord that extends between a third hole of the mask and a fourth hole of the mask. In embodiments, the neck loop comprises a third portion of the cord that extends between the second hole of the mask and the third hole of the mask.

In embodiments, the first hole, the second hole, the third hole, and the fourth hole each comprises a respective through hole that extends from a back surface of the mask to a front surface of the mask.

In embodiments, the first hole and the second hole are defined by a first side edge of the mask being folded over and attached to an interior of the mask, and the third hole and the fourth hole are defined by a second side edge of the mask being folded over and attached to the interior of the mask. In embodiments, a first channel extends between the first hole and the second hole, and a second channel extends between the third hole and the fourth hole. In embodiments, the first attachment location is inside the first channel, and the second attachment location is inside the second channel. In embodiments, the cord extends completely through the first channel and completely through the second channel.

In embodiments, the first hole and the second hole are located on a first side of an axis that bisects the mask in a vertical direction, and the third hole and the fourth hole are located on a second side of the axis that bisects the mask in the vertical direction. In embodiments, the first hole and the second hole are located closer to a first side edge of the mask than they are to the axis that bisects the mask in the vertical direction, and the third hole and the fourth hole are located closer to a second side edge of the mask than they are to the axis that bisects the mask in the vertical direction. In embodiments, the first hole and the fourth hole are located on a first side of an axis that bisects the mask in a horizontal direction, and the second hole and the third hole are located on a second side of the axis that bisects the mask in the horizontal direction.

In embodiments, the mask is configured to filter airborne pollutants and/or pathogens from entering an airway of the user wearing the mask. In embodiments, the mask is sized and shaped to cover a mouth and nose of the user when the mask is worn on the face of the user. In embodiments, the neck loop is configured to be worn on a back of the neck of the user when the mask is worn on the face of the user. In embodiments, the neck loop is configured to hold the mask via the neck of the user when the user removes the mask from their face. In embodiments, the neck loop is configured to hold the mask on the neck of the user when the user removes the first ear loop from the first ear and the second ear loop from the second ear. In embodiments, there is a method of manufacturing the face mask system.

BRIEF DESCRIPTION OF THE SEVERAL VIEWS OF THE DRAWINGS

Aspects of the present invention are described in the detailed description which follows, in reference to the noted plurality of drawings by way of non-limiting examples of exemplary embodiments of the present invention.

DETAILED DESCRIPTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of aspects of the present invention in more detail than is necessary for the fundamental understanding of the aspects of the present invention, the description taken with the drawings making apparent to those skilled in the art how the several forms of aspects of the present invention may be embodied in practice.

Figure 1:
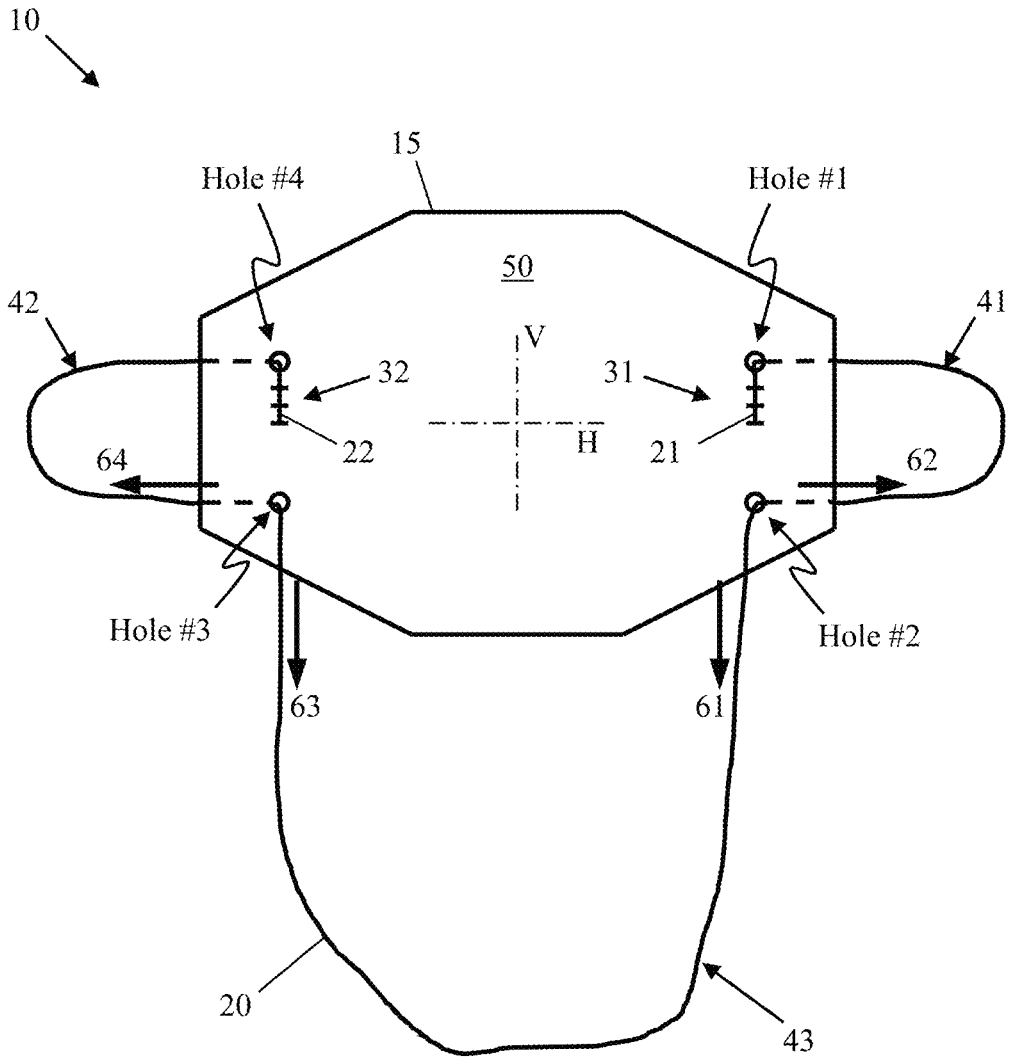
FIGS. 1 and 9 show a mask system in accordance with aspects of the invention.

FIG. 1 shows an exemplary implementation of a mask system 10 in accordance with aspects of the invention. As shown in FIG. 1, the mask system 10 includes a mask 15 that is configured to be worn on the face of a user, and a cord 20 that is connected to the mask and that is configured to secure the mask 15 to the user by way of the cord 20 looping around ears of the user wearing the mask 15. According to aspects of the invention, the cord 20 extends continuously between a first end 21 of the cord that is attached to the mask 15 at a first attachment location 31 and a second end 22 of the cord that is attached to the mask 15 at a second attachment location 32, with the cord 20 arranged relative to the mask 15 to provide a first ear loop 41, a second ear loop 42, and a neck loop 43. The cord 20 connected and arranged in this manner provides a pulley system that permits individual adjustment of the tightness of each of the first ear loop 41 and the second ear loop 42.

In the exemplary implementation shown in FIG. 1, the first end 21 of the cord 20 is attached to mask 15 at the first attachment location 31 on a back side 50 of the mask. In embodiments, the back side 50 of the mask 15 is the side of the mask 15 that is facing toward the user's face when the user is wearing the mask 15, with a front side of the mask 15 being opposite the back side 50 and facing away from the user's face when the user is wearing the mask 15. The exemplary implementation shown in FIG. 1 is described with the first attachment location 31 and the second attachment location 32 being on the back side 50 of the mask 15; however, it should be understood that the back side and the front side can be reversed, such that the first attachment location 31 and the second attachment location 32 can be on the front side of the mask 15 without departing from the scope of the invention.

With continued reference to FIG. 1, in this exemplary embodiment the cord 20 extends from its first end 21 at the first attachment location 31 through Hole #1, thus passing from the back side 50 of the mask 15 through Hole #1 to the front side of the mask 15. From Hole #1 the cord 20 extends to Hole #2, where the cord passes from the front side of the mask 15 through Hole #2 to the back side 50 of the mask 15. A portion of the cord 20 between Hole #1 and Hole #2 forms the first ear loop 41. From Hole #2 the cord 20 extends to Hole #3, where the cord passes from the back side 50 side of the mask 15 through Hole #3 to the front side of the mask 15. A portion of the cord 20 between Hole #2 and Hole #3 forms the neck loop 43. From Hole #3 the cord 20 extends to Hole #4, where the cord passes from the front side of the mask 15 through Hole #4 to the back side 50 of the mask 15. A portion of the cord 20 between Hole #3 and Hole #4 forms the second ear loop 42. After passing through Hole #4, the second end 22 of the cord 20 is attached to the back side 50 of the mask 15 at the second attachment location 32.

Still referring to the exemplary implementation shown in FIG. 1, a user may don the mask 15 by placing the back side 50 of the mask 15 against their face, placing the first ear loop 41 around a first one of their ears, placing the second ear loop 42 around a second one of their ears, and placing the neck loop 43 behind their neck (not necessarily in that order, however). With the mask system 10 thus positioned on the user, the user may increase the tightness of the first ear loop 41 around the user's first ear by pulling a portion of the neck loop 43 of the cord 20 away from Hole #2 as indicated by arrow 61, which pulls the cord 20 through Hole #2 and decreases the size of the first ear loop 41, thus tightening the first ear loop 41 around the user's first ear. With the mask system 10 thus positioned on the user, the user may decrease the tightness of the first ear loop 41 around the user's first ear by pulling a portion of the first ear loop 41 of the cord 20 away from Hole #2 as indicated by arrow 62, which pulls the cord 20 through Hole #2 and increases the size of the first ear loop 41, thus loosening the first ear loop 41 around the user's first ear.

In embodiments, the second ear loop 42 may be adjusted in a manner similar to that described with respect to the first ear loop 41. For example, the user may increase the tightness of the second ear loop 42 around the user's second ear by pulling a portion of the neck loop 43 of the cord 20 away from Hole #3 as indicated by arrow 63, which pulls the cord 20 through Hole #3 and decreases the size of the second ear loop 42, thus tightening the second ear loop 42 around the user's second ear. The user may decrease the tightness of the second ear loop 42 around the user's second ear by pulling a portion of the second ear loop 42 of the cord 20 away from Hole #3 as indicated by arrow 64, which pulls the cord 20 through Hole #3 and increases the size of the second ear loop 42, thus loosening the second ear loop 42 around the user's second ear.

In embodiments, the cord 20 is designed with a sufficient length to permit independent adjustment (e.g., tightening and loosening) of the one of the ear loops 41, 42 without affecting the adjustment of the other one of the ear loops 41, 42. In this manner, the ear loops 41, 42 may be adjusted independently of one another to achieve a desired comfort for the user. In a preferred embodiment, the cord 20 has a length of about 52 inches between the first end 21 and the second end 22, although implementations of the invention are not limited to this length and other lengths may be used.

With continued reference to FIG. 1, the neck loop 43 provides a particularly advantageous aspect of implementations of the invention. When the user is wearing the mask 15 against their face with the first ear loop 41 around their first ear, the second ear loop 42 around their second ear, and the neck loop 43 behind their neck, the user may remove the mask 15 from their face (e.g., by removing the ear loops 41, 42 from the ears) and let the mask 15 hang on (e.g., around) their neck by the neck loop 43. In this manner, the user may temporarily remove the mask 15 from their face and let the mask 15 hang on their neck via the neck loop, and the mask 15 in this position is conveniently located for quickly putting back on their face. Another benefit of this aspect is that the user is less likely to lose their mask since they need not completely remove it from their body, but can instead let it hang on their neck when they wish to temporarily remove the mask 15 from their face.

As described herein, the cord 20 in accordance with aspects of the invention extends continuously between its first end 21 and its second end 22. The cord 20 may be composed of any suitable conventional or later-developed material or combination of materials including but not limited to: cotton, silk, linen, wool, tencel, bamboo, hemp, acrylic, polyester, nylon, and spandex. The cord 20 may comprise only one continuous section of material, or may comprise two or more distinct sections of a same material or different materials connected (e.g., end-to-end) to form the continuous extent of the cord 20. The ends 21, 22 of the cord 20 may be attached to the mask 15 at the attachment locations 31, 32 using any suitable technique including but not limited to: knotting, soldering, welding, sewing, adhesive, or any combination of conventional or later-developed techniques for fixedly securing an end of the cord 20 to the mask 15.

The mask 15 may be composed of any suitable conventional or later-developed material or combination of materials including but not limited to: cotton, silk, linen, wool, tencel, bamboo, hemp, acrylic, polyester, nylon, and spandex. The mask 15 may comprise a single layer or plural layers connected to one another. The mask 15 may be designed for filtering airborne pollutants and/or pathogens, e.g., for the protection of the person wearing the mask and/or people around the person wearing the mask. The mask 15 may have any desired shape.

With continued reference to FIG. 1, each of the holes (Hole #1, Hole #2, Hole #3, Hole #4) extends completely through the mask 15, e.g., from the back side 50 of the mask 15 to the front side of the mask 15. In embodiments, Hole #1 and Hole #2 are located relatively close to a first side edge of the mask 15, and Hole #3 and Hole #4 are located relatively close to a second side edge of the mask 15 that is opposite the first side edge of the mask 15.

In embodiments, Hole #1 and Hole #2 are located on a first side of an axis V that bisects the mask 15 in a vertical direction, and Hole #3 and Hole #4 are located on a second side of the axis V opposite the first side of the axis V. In embodiments, Hole #1 and Hole #2 are located closer to a first side edge of the mask 15 than they are to the axis V, and Hole #3 and Hole #4 are located closer to a second side edge of the mask 15 than they are to the axis V. In embodiments, Hole #1 and Hole #4 are located on a first side of an axis H that bisects the mask 15 in a horizontal direction, and Hole #2 and Hole #3 are located on a second side of the axis H opposite the first side of the axis H.

Figure 2:
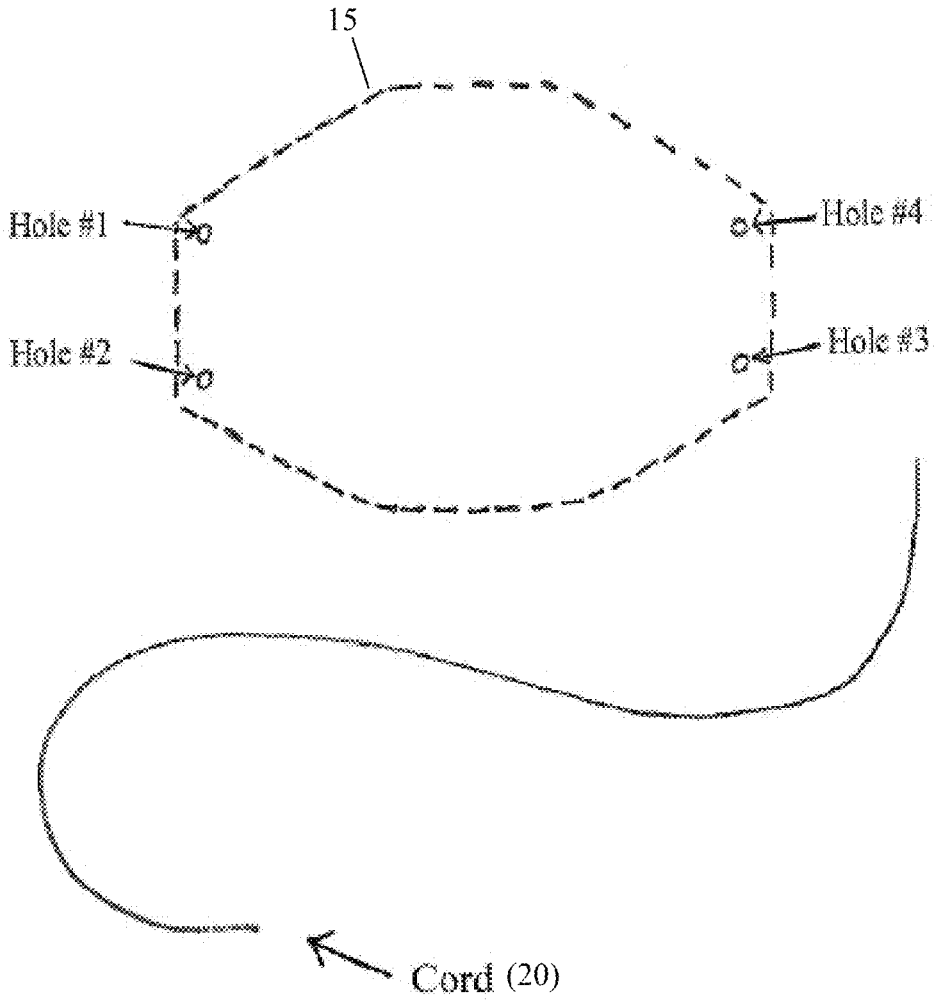
FIG. 2-8 show a sequence of steps of assembling the mask system in accordance with aspects of the invention.

FIG. 2-8 show a sequence of steps of assembling the mask system in accordance with aspects of the invention. FIG. 2 shows the mask 15 and cord 20, the mask 15 including four through holes: Hole #1, Hole #2, Hole #3, Hole #4.

Figure 3:
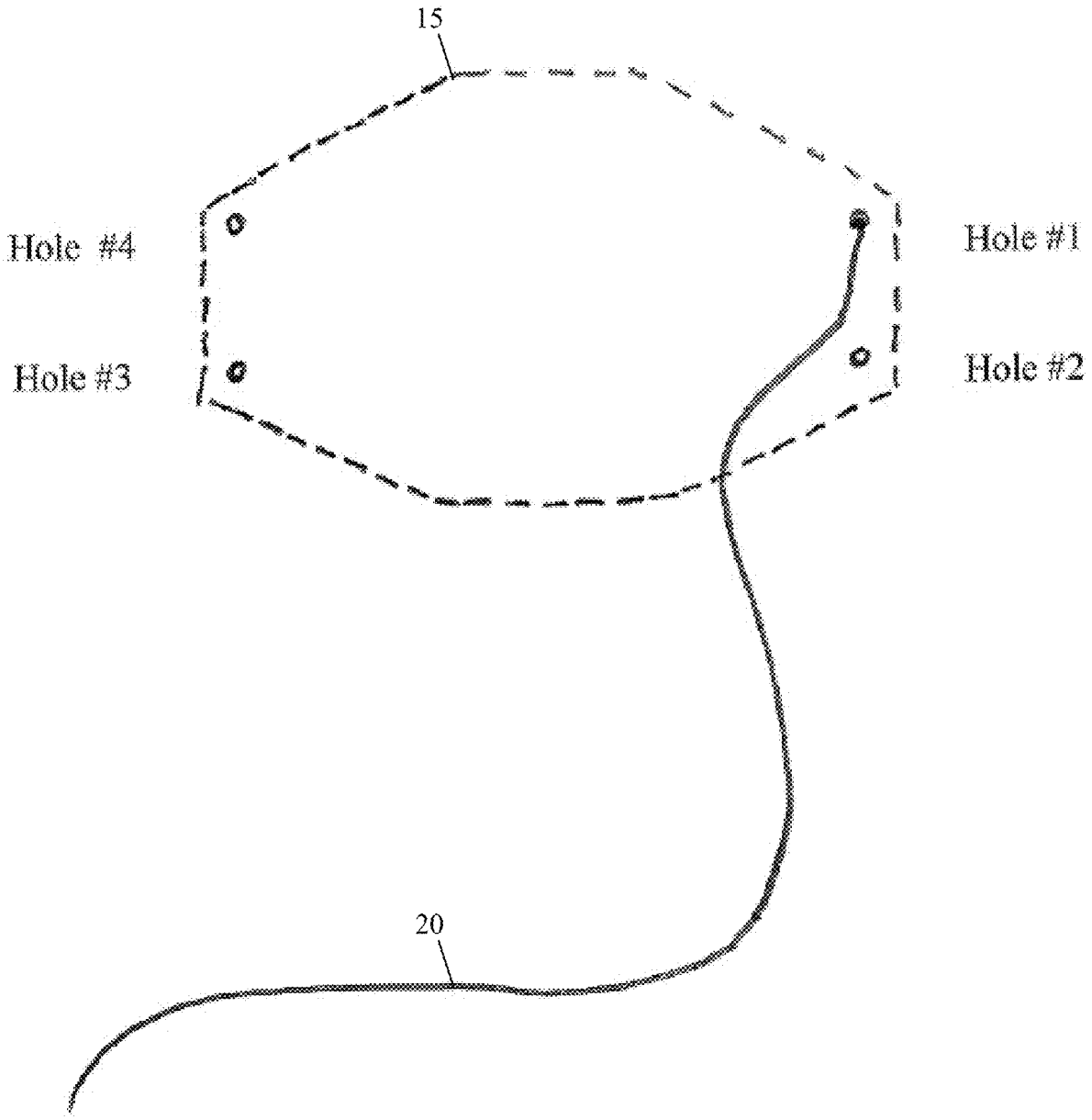

As shown in FIG. 3, a first end 21 of the cord 20 is secured to the back side 50 of the mask 15 near Hole #1.

Figure 4:
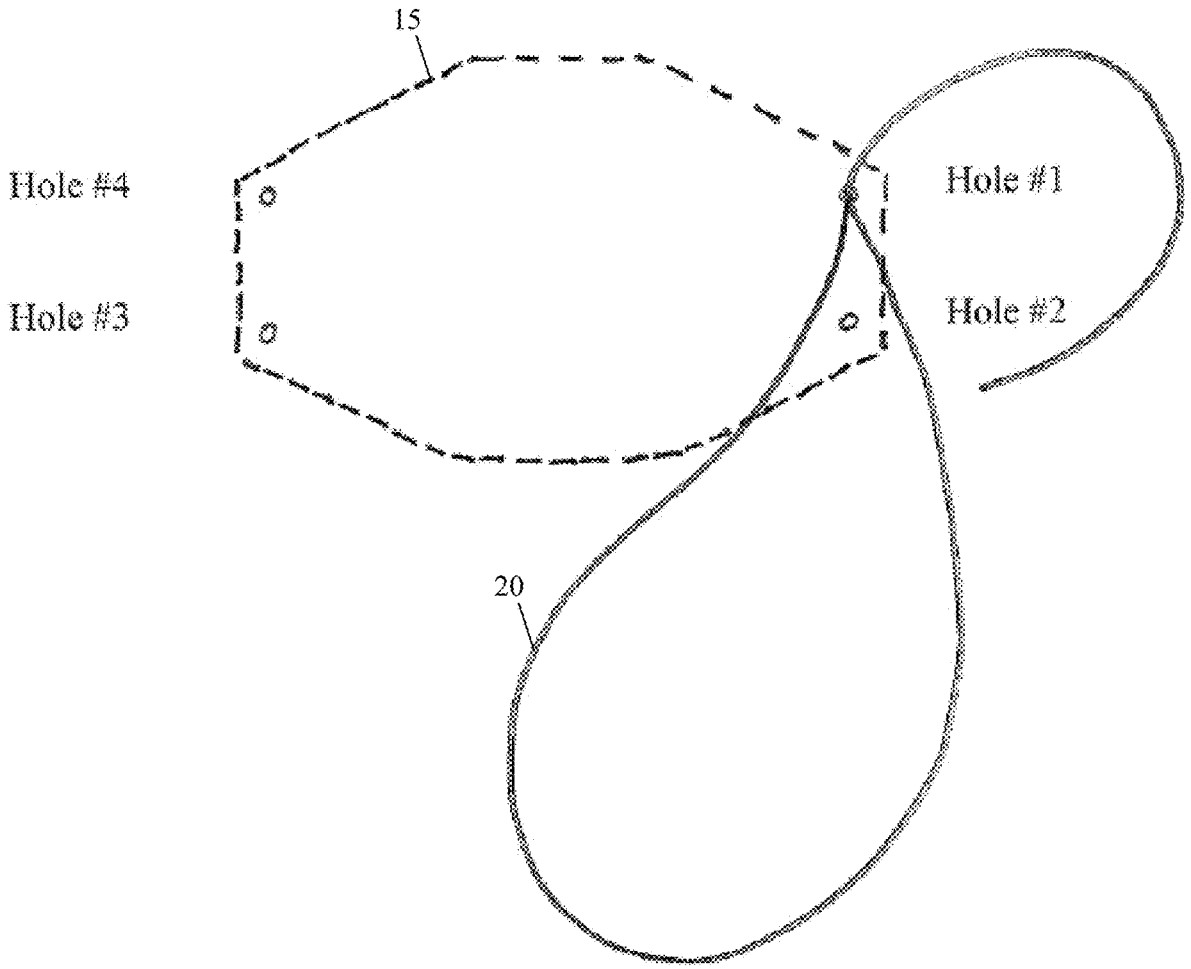

As shown in FIG. 4, from the back side 50 of the mask 15, enter the second end 22 of the cord 20 through Hole #1.

Figure 5:
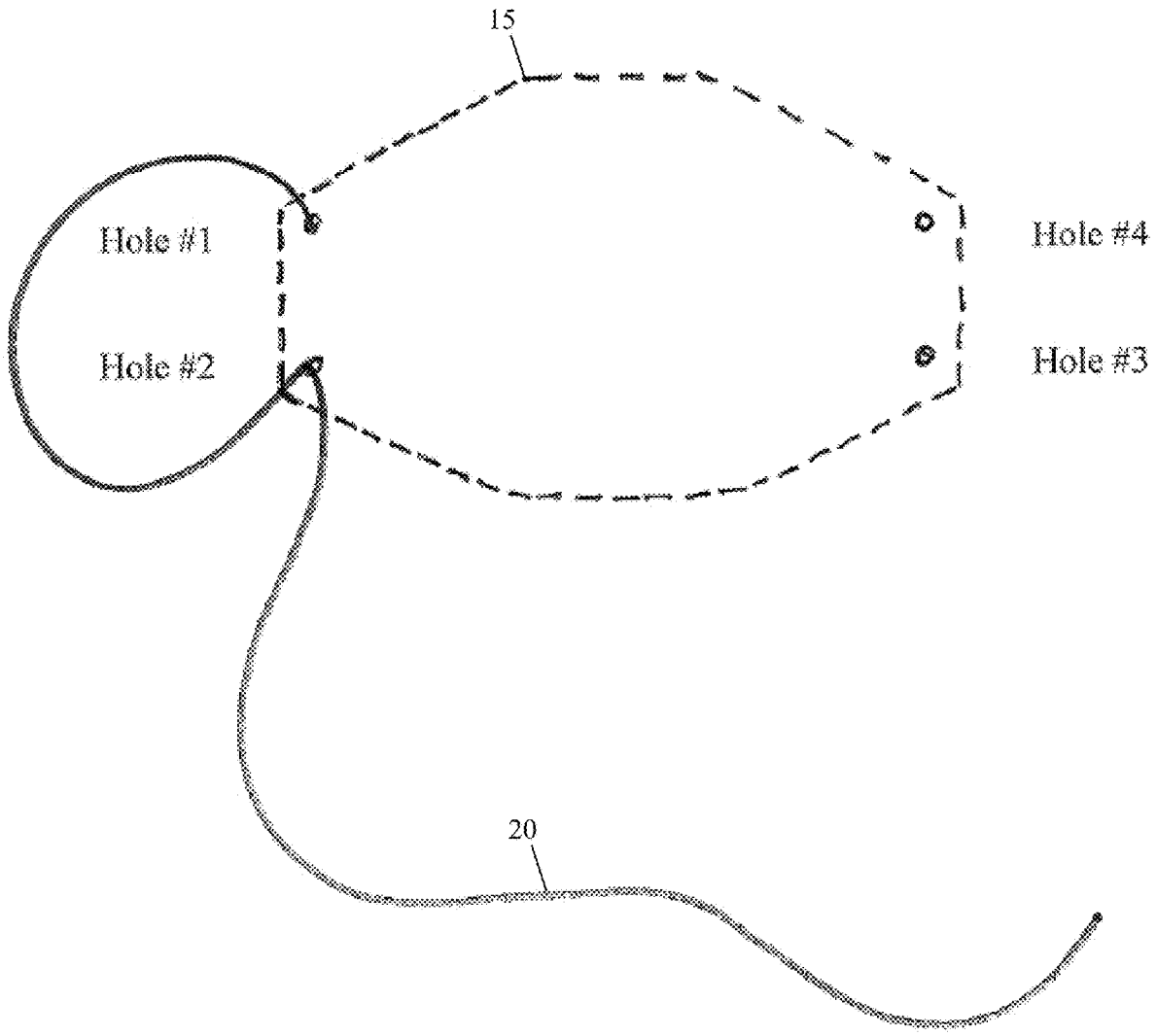

As shown in FIG. 5, from the front of Hole #1, thread the cord 20 to the front of Hole #2, thus creating one loop on one side for one ear (e.g., first ear loop 41).

Figure 6:
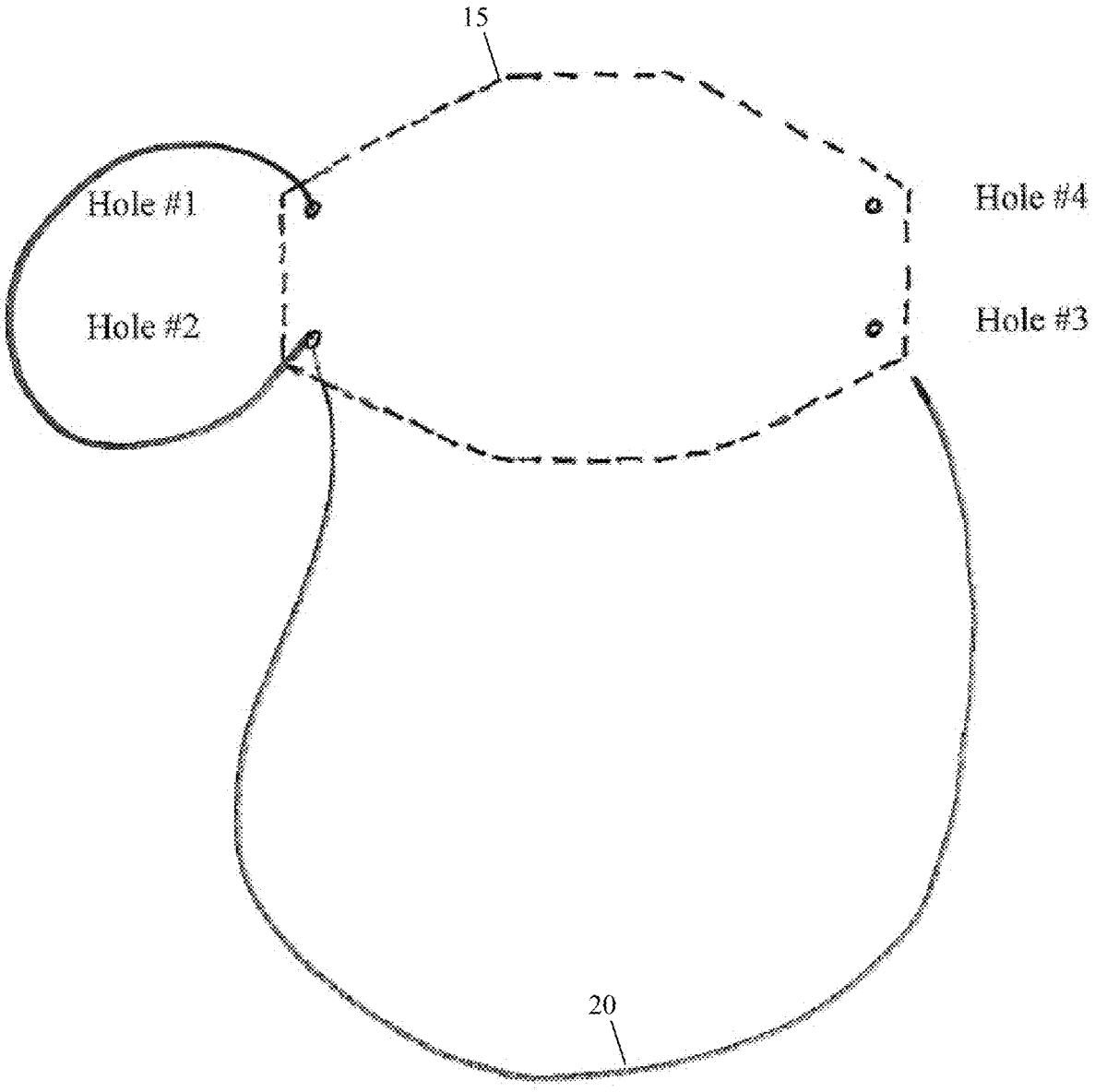

As shown in FIG. 6, continue threading the cord 20 on the back side 50 of the mask 15 to Hole #3, leaving slack of the cord 20 for a neck catch (e.g., neck loop 43).

Figure 7:
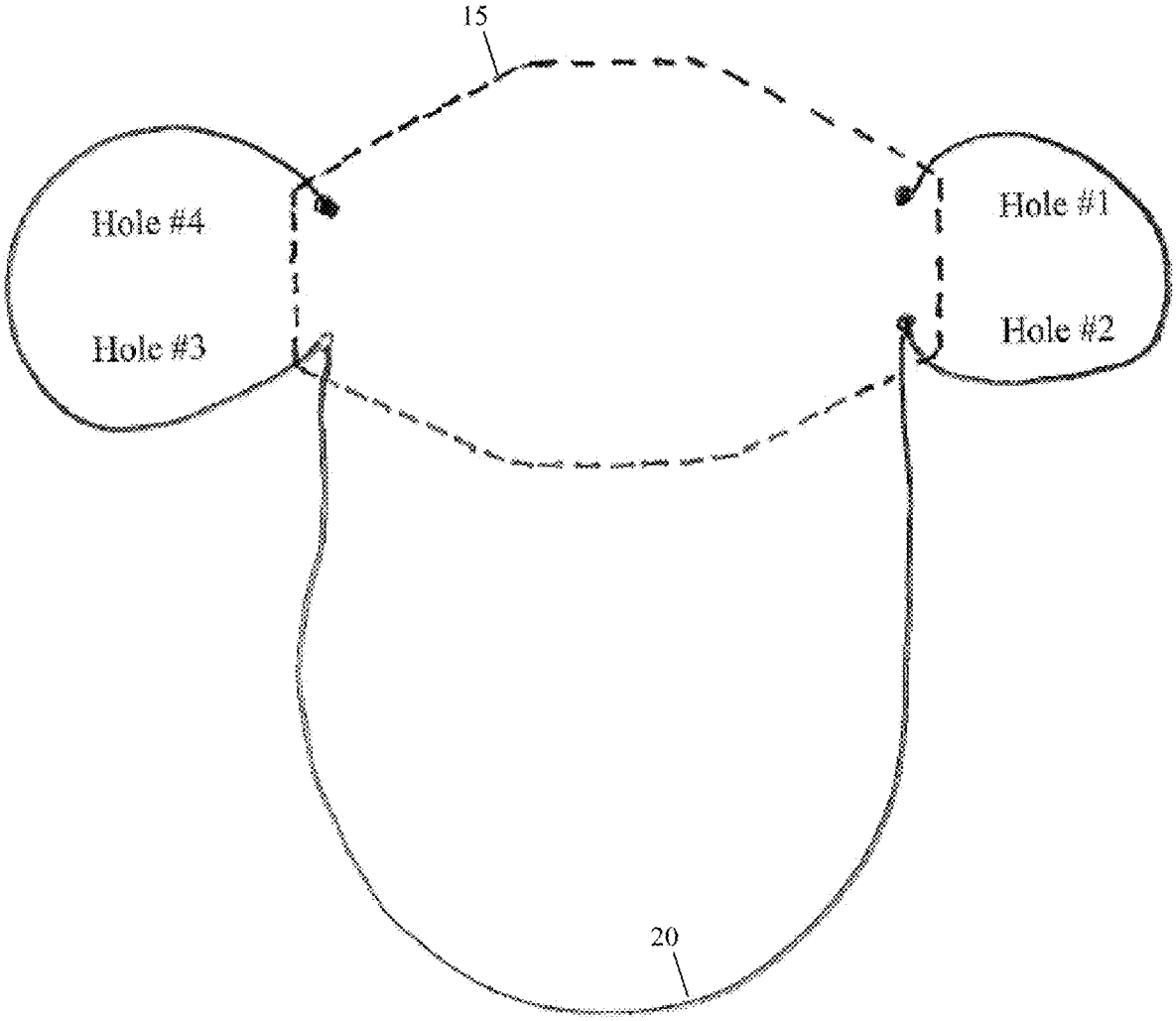

As shown in FIG. 7, from the back of mask 15 at Hole #3, thread the cord 20 to the front of mask 15 to Hole #4, securing the cord 20 on the back side 50 of Hole #4, thus creating the second loop on the other side for the other ear (e.g., the second ear loop 42). At this point, the mask system 10 is created with adjustable ear loops 41, 42 and neck catch (e.g., neck loop 43).

Figure 8:
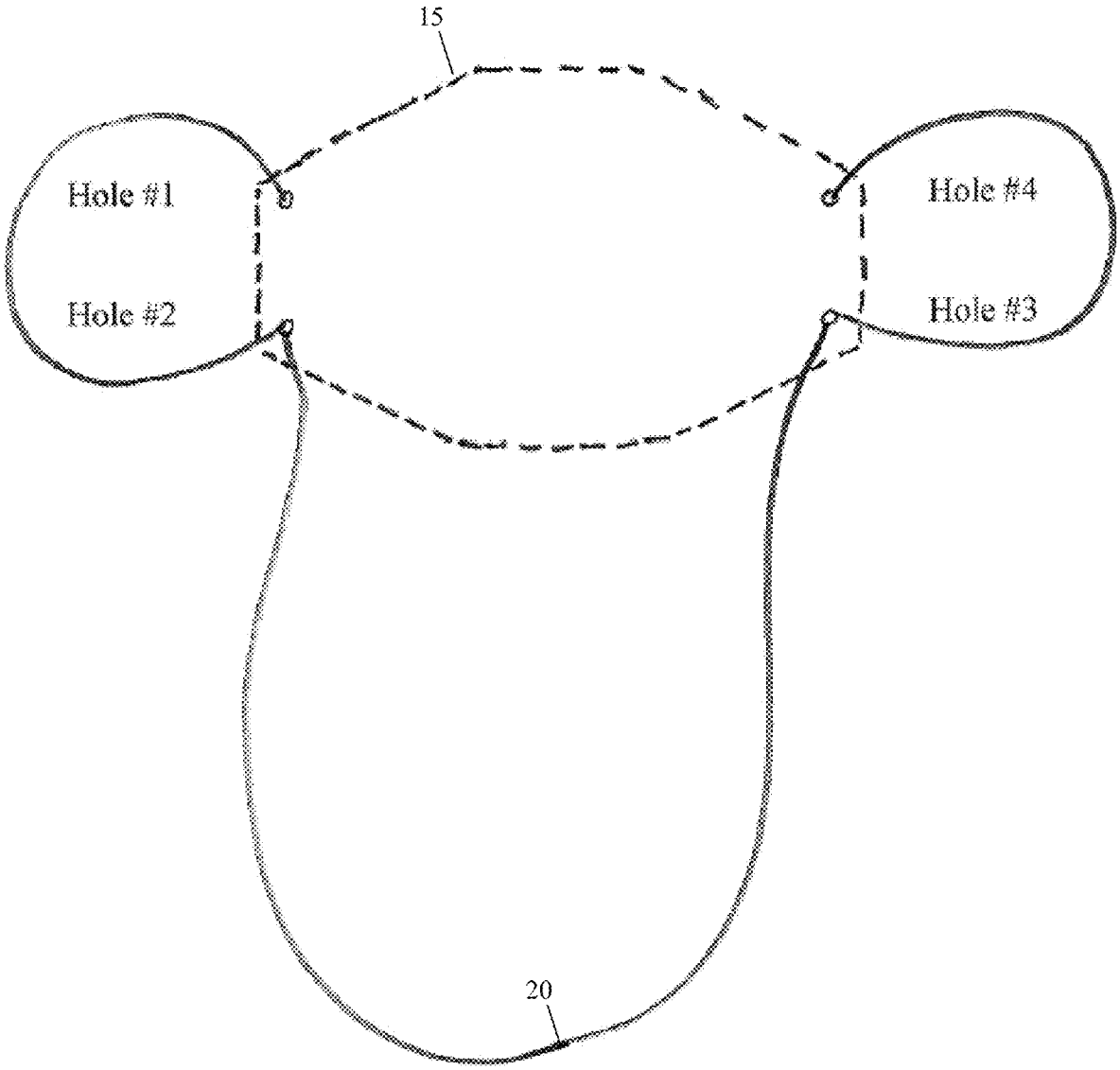

To use the mask system 10, a user places the neck catch (e.g., neck loop 43) around their neck and the ear loops 41, 42 around their ears. The user then tugs the cord 20 below each ear adjusting pulley system around each ear for individual security and comfort, e.g., as shown in FIG. 8.

Figure 9:
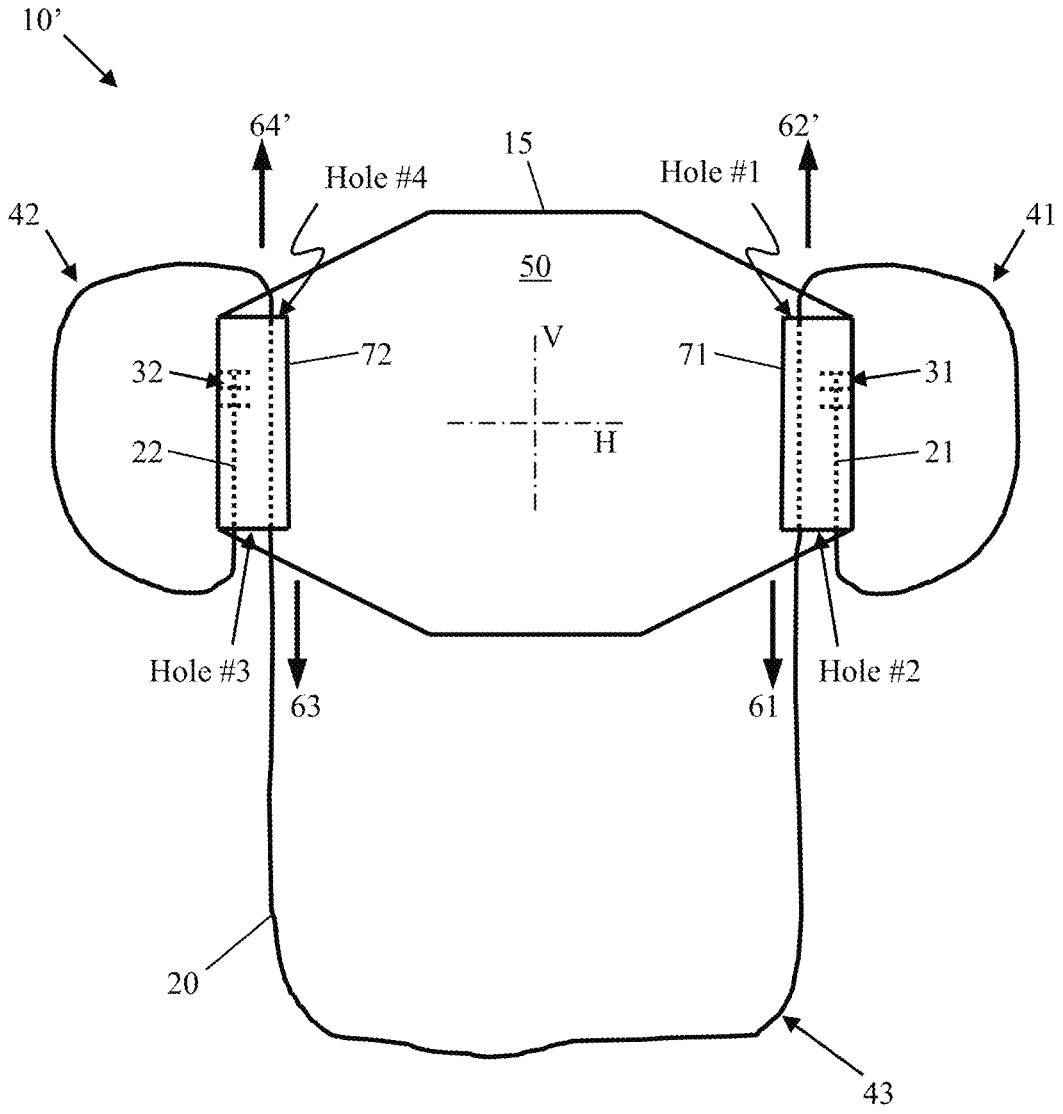

FIGS. 1-8 show an exemplary implementation of a mask system 10 in which the holes are formed as through-holes through the mask. FIG. 9 shows an exemplary implementation of a mask system 10' in which the holes are formed by folding over side edges of the mask. In embodiments, the mask system 10' of FIG. 9 is the same as the mask system 10 of FIG. 1 except where described differently herein.

In accordance with aspects of the invention, and as shown in FIG. 9, the mask system 10' includes holes (Hole #1, Hole #2, Hole #3, Hole #4) that are formed by folding over side edges of the mask 15 and securing the side edges to an interior portion of the mask 15. For example, Hole #1 and Hole #2 are formed by folding the first side edge 71 of the mask 15 toward the center of the mask 15 and securing the first side edge 71 to an interior portion of the mask 15. Folding and securing the first side edge 71 in this manner creates a channel with Hole #1 at a first end of the channel and Hole #2 at a second end of the channel opposite the first end of the channel. In a similar manner, Hole #3 and Hole #4 are formed by folding the second side edge 72 of the mask 15 toward the center of the mask 15 and securing the second side edge 72 to an interior portion of the mask 15. The sides edges 71, 72 may be secured to the respective interior portions of the mask 15 using any suitable technique including but not limited to: soldering, welding, sewing, adhesive, snaps, hook and loop fastener, or any combination of conventional or later-developed techniques.

With continued reference to FIG. 9, in this exemplary embodiment the first end 21 of the cord 20 is secured to the mask 15 at the first attachment location 31, which is inside the channel between Hole #1 and Hole #2. In one exemplary method of manufacturing the mask system 10', the first end 21 of the cord 20 is secured to the mask 15 at the first attachment location 31 prior to folding and securing the first side edge 71 to the interior portion of the mask 15. Similarly, the second end 22 of the cord 20 is secured to the mask 15 at the second attachment location 32, which is inside the channel between Hole #3 and Hole #4.

Still referring to FIG. 9, in this exemplary embodiment the cord 20 extends from its first end 21 at the first attachment location 31 to Hole #2 and there it exits the channel defined between Hole #1 and Hole #2. From Hole #2 the cord 20 extends to Hole #1, where the cord 20 enters the same channel again. A portion of the cord 20 between Hole #1 and Hole #2 forms the first ear loop 41. From Hole #1 the cord 20 extends through the channel to Hole #2, where the cord 20 exits the channel again and then extends to Hole #3, where the cord 20 enters the channel defined between Hole #3 and Hole #4. A portion of the cord 20 between Hole #2 and Hole #3 forms the neck loop 43. From Hole #3 the cord 20 extends through this channel to Hole #4, where the cord 20 exits this channel and loops back around to enter the same channel again at Hole #3. A portion of the cord 20 between Hole #3 and Hole #4 forms the second ear loop 42. After passing through Hole #3, the second end 22 of the cord 20 is attached to the back side 50 of the mask 15 at the second attachment location 32.

Still referring to the exemplary implementation shown in FIG. 9, a user may don the mask 15 by placing the back side 50 of the mask 15 against their face, placing the first ear loop 41 around a first one of their ears, placing the second ear loop 42 around a second one of their ears, and placing the neck loop 43 behind their neck (not necessarily in that order, however). With the mask system 10' thus positioned on the user, the user may increase the tightness of the first ear loop 41 around the user's first ear by pulling a portion of the neck loop 43 of the cord 20 away from Hole #2 as indicated by arrow 61, which pulls the cord 20 through Hole #2 and decreases the size of the first ear loop 41, thus tightening the first ear loop 41 around the user's first ear. With the mask system 10 thus positioned on the user, the user may decrease the tightness of the first ear loop 41 around the user's first ear by pulling a portion of the first ear loop 41 of the cord 20 away from Hole #1 as indicated by arrow 62', which pulls the cord 20 through Hole #1 and increases the size of the first ear loop 41, thus loosening the first ear loop 41 around the user's first ear.

In embodiments, the second ear loop 42 may be adjusted in a manner similar to that described with respect to the first ear loop 41. For example, the user may increase the tightness of the second ear loop 42 around the user's second ear by pulling a portion of the neck loop 43 of the cord 20 away from Hole #3 as indicated by arrow 63, which pulls the cord 20 through Hole #3 and decreases the size of the second ear loop 42, thus tightening the second ear loop 42 around the user's second ear. The user may decrease the tightness of the second ear loop 42 around the user's second ear by pulling a portion of the second ear loop 42 of the cord 20 away from Hole #4 as indicated by arrow 64', which pulls the cord 20 through Hole #4 and increases the size of the second ear loop 42, thus loosening the second ear loop 42 around the user's second ear.

It is noted that the foregoing examples have been provided merely for the purpose of explanation and are in no way to be construed as limiting aspects of the present invention. While aspects of the present invention have been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although aspects of the present invention have been described herein with reference to particular means, materials and embodiments, aspects of the present invention are not intended to be limited to the particulars disclosed herein; rather, aspects of the present invention extend to all functionally equivalent structures, methods and uses, such as are within the scope of the appended claims.

What is claimed:

1. A face mask system, comprising:

a mask configured to be worn on a face of a user; and a cord extending continuously between a first end of the cord attached to the mask at a first attachment location and a second end of the cord attached to the mask at a second attachment location, wherein the cord forms a first ear loop configured to be worn around a first ear of the user, a second ear loop configured to be worn around a second ear of the user, and a neck loop configured to be worn on a neck of the user, the first ear loop comprises a first portion of the cord that extends between a first hole of the mask and a second hole of the mask, and the second ear loop comprises a second portion of the cord that extends between a third hole of the mask and a fourth hole of the mask.

2. The face mask system of claim 1, wherein the cord provides a pulley system that permits individual adjustment of a respective tightness of each of the first ear loop and the second ear loop.

3. The face mask system of claim 1, wherein:

a tightness of the first ear loop is adjustable independently of a tightness of the second ear loop; and the tightness of the second ear loop is adjustable independently of the tightness of the first ear loop.

4. The face mask system of claim 1, wherein:

the first ear loop is adapted to be tightened by pulling on a first portion of the cord;

the first ear loop is adapted to be loosened by pulling on a second portion of the cord;

the second ear loop is adapted to be tightened by pulling on a third portion of the cord; and the second ear loop is adapted to be loosened by pulling on a fourth portion of the cord.

5. The face mask system of claim 1, the neck loop comprises a third portion of the cord that extends between the second hole of the mask and the third hole of the mask.

6. The face mask system of claim 5, wherein the first hole, the second hole, the third hole, and the fourth hole each comprises a respective through hole that extends from a back surface of the mask to a front surface of the mask.

7. The face mask system of claim 5, wherein:

the first hole and the second hole are defined by a first side edge of the mask being folded over and attached to an interior of the mask; and the third hole and the fourth hole are defined by a second side edge of the mask being folded over and attached to the interior of the mask.

8. The face mask system of claim 7, wherein:

a first channel extends between the first hole and the second hole; and a second channel extends between the third hole and the fourth hole.

9. The face mask system of claim 8, wherein:

the first attachment location is inside the first channel; and the second attachment location is inside the second channel.

10. The face mask system of claim 9, wherein the cord extends completely through the first channel and completely through the second channel.

11. The face mask system of claim 5, wherein:

the first hole and the second hole are located on a first side of an axis that bisects the mask in a vertical direction; and the third hole and the fourth hole are located on a second side of the axis that bisects the mask in the vertical direction.

12. The face mask system of claim 11, wherein:

the first hole and the second hole are located closer to a first side edge of the mask than they are to the axis that bisects the mask in the vertical direction; and the third hole and the fourth hole are located closer to a second side edge of the mask than they are to the axis that bisects the mask in the vertical direction.

13. The face mask system of claim 12, wherein:

the first hole and the fourth hole are located on a first side of an axis that bisects the mask in a horizontal direction; and the second hole and the third hole are located on a second side of the axis that bisects the mask in the horizontal direction.

14. The face mask system of claim 1, wherein the mask is configured to filter airborne pollutants and/or pathogens from entering an airway of the user wearing the mask.

15. The face mask system of claim 1, wherein the mask is sized and shaped to cover a mouth and nose of the user when the mask is worn on the face of the user.

16. The face mask system of claim 1, wherein the neck loop is configured to be worn on a back of the neck of the user when the mask is worn on the face of the user.

17. The face mask system of claim 16, wherein the neck loop is configured to hold the mask via the neck of the user when the user removes the mask from their face.

18. The face mask system of claim 16, wherein the neck loop is configured to hold the mask on the neck of the user when the user removes the first ear loop from the first ear and the second ear loop from the second ear.

19. A method of manufacturing the face mask system of claim 1, the method comprising:

attaching the first end of the cord to the mask at the first attachment location; and attaching the second end of the cord to the mask at the second attachment location.

* * * * *